US008434730B2

(12) United States Patent
Ahlstrom

(10) Patent No.: US 8,434,730 B2
(45) Date of Patent: May 7, 2013

(54) SECURING DEVICES FOR WALL HANGINGS AND ASSOCIATED SYSTEMS AND METHODS

(76) Inventor: Tonya Ahlstrom, Alpine, UT (US)

( * ) Notice: Subject to any disclaimer, the term of this patent is extended or adjusted under 35 U.S.C. 154(b) by 780 days.

(21) Appl. No.: 12/502,805

(22) Filed: Jul. 14, 2009

(65) Prior Publication Data

US 2011/0011994 A1 Jan. 20, 2011

(51) Int. Cl.
*A47F 1/14* (2006.01)

(52) U.S. Cl.
USPC ..... 248/467; 248/206.5; 248/475.1; 248/547; 248/683

(58) Field of Classification Search ..... 248/467, 248/475.1, 477, 489, 206.5, 683, 547, 217.4
See application file for complete search history.

(56) References Cited

U.S. PATENT DOCUMENTS

| | | | | |
|---|---|---|---|---|
| 3,239,178 | A * | 3/1966 | Pompa | 248/205.3 |
| 3,604,673 | A * | 9/1971 | Klein | 248/467 |
| 3,836,766 | A * | 9/1974 | Auerbach | 362/311.14 |
| 4,211,382 | A * | 7/1980 | Bonfils | 248/467 |
| 4,384,648 | A * | 5/1983 | Hart et al. | 206/527 |
| 5,269,083 | A | 12/1993 | Vampatella et al. | |
| 6,651,945 | B2 | 11/2003 | Rivellino et al. | |
| 6,672,551 | B2 | 1/2004 | Rivellino et al. | |
| 2002/0079412 | A1 * | 6/2002 | Pitlor | 248/206.5 |
| 2004/0021052 | A1 * | 2/2004 | Dagan | 248/441.1 |
| 2009/0140120 | A1 | 6/2009 | Nicolaisen | |

FOREIGN PATENT DOCUMENTS

GB 2191089 12/1987

* cited by examiner

*Primary Examiner* — Gwendolyn Baxter
(74) *Attorney, Agent, or Firm* — Workman Nydegger

(57) ABSTRACT

Devices and systems for leveling wall hangings and for maintaining the wall hangings level can include magnets and magnetic targets. As an example, a magnet can be secured to one of a wall hanging and a wall, and the magnetic target can be secured to the other of a wall hanging and a wall. Interaction between the magnet and the magnetic target can aid in positioning the wall hanging. The magnetic target can include another magnet or a magnetic material.

8 Claims, 4 Drawing Sheets

SECURING DEVICES FOR WALL HANGINGS AND ASSOCIATED SYSTEMS AND METHODS

TECHNICAL FIELD

The present disclosure relates to wall hangings and associated devices.

SUMMARY

Embodiments of devices for securing wall hangings in desired orientations and/or for maintaining the wall hangings in the desired orientations, as well as related systems and methods, are disclosed.

BRIEF DESCRIPTION OF THE DRAWINGS

The accompanying drawings depict various illustrative embodiments and, therefore, should not be considered as limiting of the scope of the present disclosure.

DETAILED DESCRIPTION

Wall hangings can be mounted via any of a variety of known systems and methods. These systems and methods generally include attachment of standard mounting hardware to both a wall and the wall hanging. For example, in some cases, a picture hook can be attached to a wall via one or more nails or screws, and a length of picture wire can be secured to picture hangers that are attached to one or more rear surfaces of the wall hanging. The wire is then draped over the hook in order to hang the wall hanging. In other cases, the picture hook, or even just a nail or screw, can be secured to the wall, and a picture hanger (e.g., an eyelet) can be secured to a rear surface of the wall hanging. The picture hanger can then be positioned over the nail, screw, or hook.

For these and many other typical hanging systems, the wall hanging can be susceptible to pivoting or otherwise shifting about a point (or multiple points) of contact between the hardware that is connected to the wall and the hardware that is connected to the wall hanging. As a result, the wall hanging itself can be susceptible to rotating relative to the wall. Any of a variety of events can cause the wall hanging to rotate, such as, for example, accidental brushing by or bumping of the wall hanging or vibration of the wall on which the wall hanging is positioned, such as may occur due to slamming doors or even earthquakes. Rotated or non-level wall hangings can be aesthetically unappealing, and time and effort can be expended undesirably in repositioning the wall hangings.

Moreover, in some cases, the wall hanging can be susceptible to disengaging entirely from the wall-mounted hardware and thereafter falling to the floor. For example, where a picture hook is mounted to the wall and picture wire is secured to the wall hanging, an upward force imparted to the wall hanging can unseat the picture wire from the hook so as to release the wall hanging from the wall. Wall hangings may sustain damage and/or cause damage to other objects when they fall.

Certain embodiments described herein can alleviate or remedy one or more of the drawbacks described above. Furthermore, in some embodiments, systems for securing a wall hanging in a desired orientation can be installed without removing previously installed mounting hardware or, stated otherwise, can be installed as a supplement to existing wall-hanging systems. Such securing systems thus can provide a convenient retrofit to existing wall-hanging systems (e.g., to wall hangings that are already installed at a desired position on a wall). These and other advantages of various embodiments described herein will be apparent from the detailed description that follows.

Figure 1:
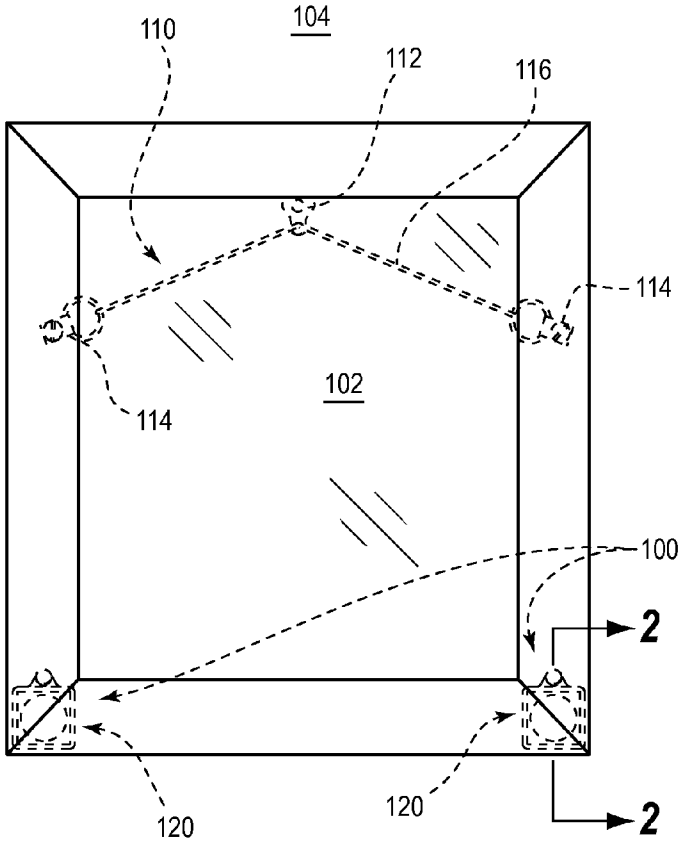
FIG. 1 is a front perspective view of an embodiment of a wall hanging coupled with an embodiment of a securing system, which is shown in broken lines.

FIG. 1 illustrates an embodiment of a securing system 100 that is attached to both a wall hanging 102 and a wall 104 so as to maintain the wall hanging 102 in a desired orientation relative to the wall 104. For example, in some embodiments, the wall hanging 102 can be maintained in a substantially level or horizontal orientation. The wall hanging 102 can include any suitable item that can be hung on or otherwise attached to a wall. For example, in various embodiments, the wall hanging 102 can comprise a framed photograph or piece of art, a shadowbox, a clock, a mirror, a sculpture, or any other suitable item of decor.

In some embodiments, the wall hanging 102 is suspended on the wall 104 via a standard wall-hanging system 110. For example, in the illustrated embodiment, the wall-hanging system 110 includes a hook 112 attached to the wall 104, two hangers 114 attached to the wall hanging 102, and a length of picture wire 116 that is secured to a separate hanger 114 at either end thereof and that is suspended on the picture hook 112.

In the illustrated embodiment, the securing system 100 includes two separate securing devices 120 that are positioned at opposite sides of the wall hanging 102. In particular, the securing devices 120 are positioned behind the bottom left and bottom right corners of the wall hanging 102. The securing devices 120 can be positioned in other orientations relative to the wall hanging 102, and in further embodiments, more or fewer securing devices 120 can be employed.

Figure 2:
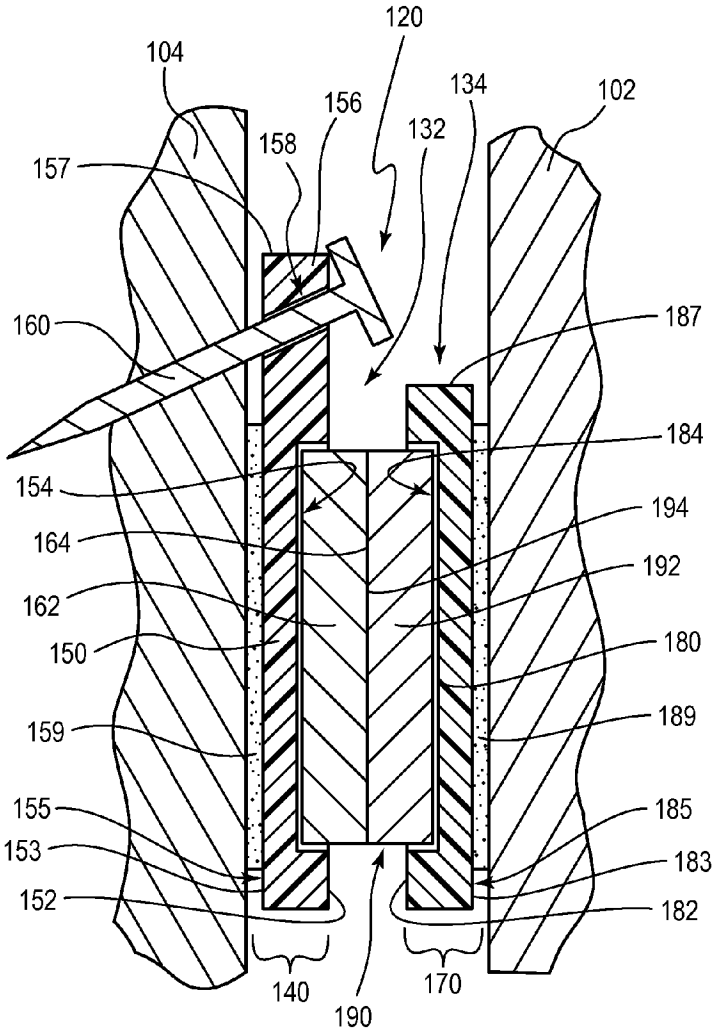
FIG. 2 is a cross-sectional view of a portion of the securing system of FIG. 1 taken along the view line 2-2 of FIG. 1.

FIG. 2 illustrates a cross-sectional view of the securing device 120 that is positioned behind the bottom right corner of the wall hanging 102. It is to be understood that, for the illustrated embodiment, the following disclosure applies equally to the securing device 120 that is positioned behind the bottom left corner of the wall hanging 102. The securing device 120 is depicted in a coupled orientation such that it maintains the wall hanging 102 in a fixed orientation relative to the wall 104. In the illustrated embodiment, the securing device 120 includes a rear connector 132 and a front connector 134. The rear and front connectors 132, 134 are configured to selectively couple with one another and, as discussed further below, the connectors 132, 134 can naturally or automatically couple with each other in a predetermined orientation. Directional terms, such as bottom, left, right, front, and rear, are used relative to the perspective shown in FIG. 1. Such terms are used for convenience and should not be construed as limiting. For example, in some embodiments, the rear and front connectors 132, 134 can be interchangeable, such that the front connector 134 is coupled with the wall 104 and is, in fact, rearward of the rear connector 132.

Figure 4:
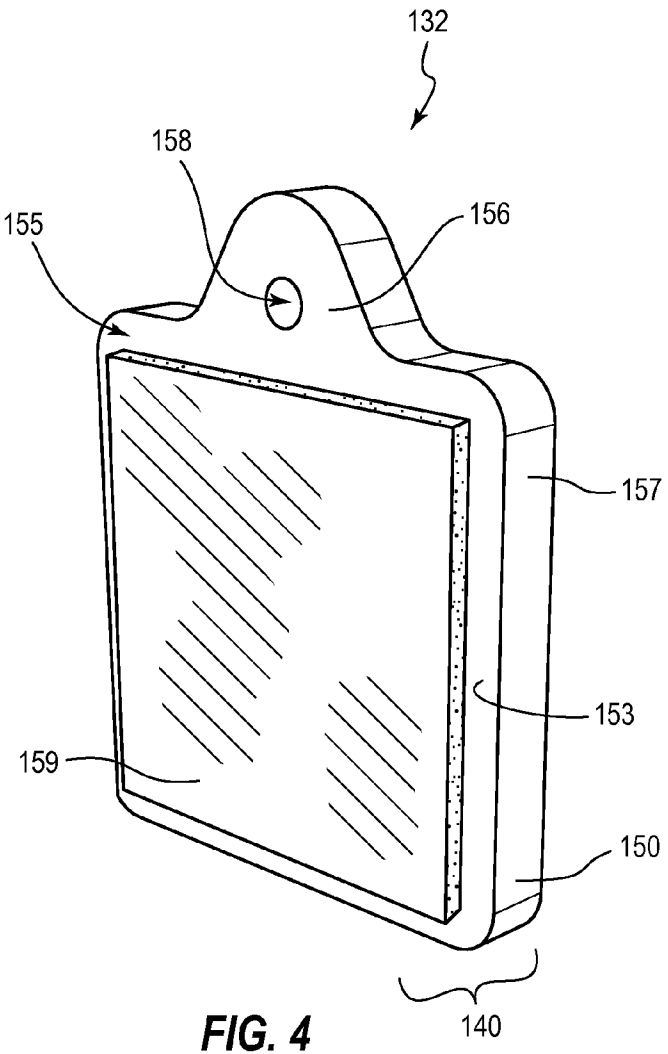
FIG. 4 is a rear perspective view of the connector of FIG. 3.

With reference to FIGS. 2 and 4, the rear connector 132 can include a mount 140 that is secured to a magnet 162. The mount 140 can be configured to secure the magnet 162 to the wall 104. The mount 140 can include a casing 150 and an adhesion member 159 connected thereto.

Figure 3:
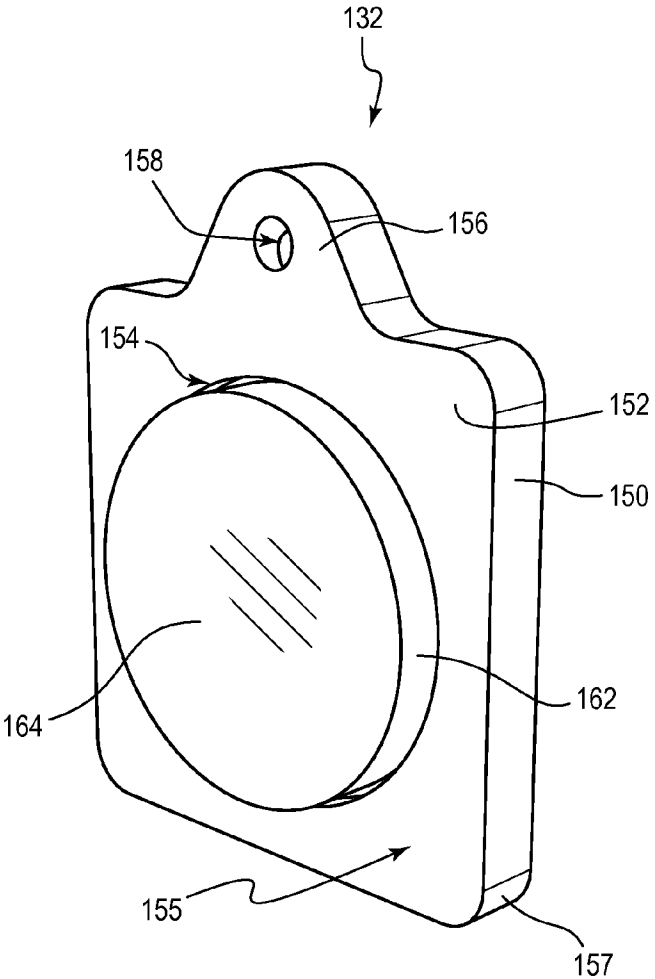
FIG. 3 is a front perspective view of an embodiment of a connector compatible with the securing system of FIG. 1.

With reference to FIGS. 2-4, in the illustrated embodiment, the casing 150 includes a front face 152 and a rear face 153, which are substantially planar and define substantially parallel planes. Other shapes and relative orientations of the front and rear faces 152, 153 are also possible. The casing 150 can define a recess 154 that extends rearward from the front face 152. The casing 150 can be sized to receive at least a portion of the magnet 162 therein. In the illustrated embodiment, the recess 154 is sufficiently deep to receive approximately one half of the magnet 162. Accordingly, a front face 164 of the magnet 162 can be outside of the recess 154, or stated otherwise, can be positioned forward of the front face 152 of the casing 150.

The casing 150 can define a ridge 155 that extends around at least a portion of the magnet 162. The ridge 155 can comprise the portion of the casing 150 that extends radially from the recess 154. In some embodiments, the ridge 155 includes a tab 156 that defines an opening or channel 158 through which a piece of mounting hardware 160, such as a nail or screw, can extend. The ridge 155 can define an outer periphery or contour 157 of the casing 150. In the illustrated embodiment, the contour 157 is substantially square-shaped with rounded corners, and further includes a rounded triangular extension at the center of one side of the square at the position of the tab 156. Other shapes of the contour 157 are also possible.

The casing 150 can be formed of any suitable material. For example, the casing 150 can comprise plastic. The casing 150 can be substantially non-magnetic so as not to interfere with a magnetic field produced by the magnet 162, which can increase the predictability of the manner in which the first and second connectors 132, 134 couple with each other. Manners in which the first and second connectors 132,134 can be coupled are discussed further below with respect to FIGS. 5A-5C.

The adhesion member 159 can be permanently joined to the rear face 153 of the casing 150. In the illustrated embodiment, the adhesion member 159 comprises a selectively removable pressure-sensitive adhesive. The term "selectively removable pressure-sensitive adhesive," as used herein, is a broad term that should be interpreted in its ordinary sense, and includes adhesives that are readily available in the adhesives industry, as well as those yet to be devised, that are configured to temporarily yet firmly bond to wall surfaces—such as, for example, wooden, wallpapered, painted, and/or other wall surfaces—substantially without leaving permanent marks thereon and/or causing damage upon removal. In various embodiments, the selectively removable pressure-sensitive adhesive can comprise any suitable adhesive available from Standard Rubber Products, Co. of Elk Grove Village, Ill. or from Minnesota Mining and Manufacturing Company (3M) of Maplewood, Minn. In some embodiments, the selectively removable pressure-sensitive adhesive can supplement the permanent coupling between the wall 104 and the rear connector 132 that is supplied by the mounting hardware 160. For example, the selectively removable pressure-sensitive adhesive can resist lateral movement of the rear connector 132 relative to the wall 104 and/or can resist removal of the rear connector 132 by forces directed perpendicular to the wall 104.

In other embodiments, the adhesion member 159 can comprise an adhesive that is configured to bond with a wall surface in a more permanent fashion. In still other embodiments, the rear connector 132 may be devoid of an adhesion member 159, and may instead be fixedly mounted to the wall 104 via the mounting hardware 160 alone. In still other embodiments, the rear connector 132 may rely only on the adhesion member 159 to be fixedly secured to the wall 104. For example, the casing 150 may be devoid of the tab 156 and the channel 158, and no mounting hardware 160 may be used in securing the rear connector 132 to the wall 104. In certain of such embodiments, the adhesion member 159 may comprise a selectively removable pressure-sensitive adhesive, whereas other of such embodiments can include more permanent adhesives. As used herein, the terms "fixedly secured" or "fixedly mounted" are broad terms that should be interpreted in their ordinary sense, and connotes fixation in a manner that resists or prohibits movement under normal conditions of use.

In various embodiments, the adhesion member 159 can be covered for purposes of packaging and shipping. For example, in some embodiments, a removable cover (not shown) is positioned on a surface of the adhesion member 159 that will eventually contact the wall 104 so as to protect the adhesion member 159 from inadvertent premature adhesion. A user can remove the cover just prior to adhering the adhesion member 159 to the wall 104.

With reference to FIGS. 2 and 3, the magnet 162 can be permanently secured to the casing 150. For example, in some embodiments, a permanent adhesive (not shown) is applied within the recess 154 of the casing 150 in order to permanently maintain the magnet 162 therein. The magnet 162 can comprise any suitable variety of magnet. In the illustrated embodiment, the magnet 162 comprises a rare-earth magnet. The type and size of the magnet 162 and the strength of a magnetic field produced thereby are variables that can be altered or selected at the manufacturing stage, depending on the application of a particular securing device 120.

As further discussed below, in some embodiments, it can be desirable for the rear connector 132 to define a relatively low profile. In various embodiments, a total thickness of the rear connector 132 can be within a range of from about 1/16 inches to about 1/4 inches or from about 1/8 inches to about 3/16 inches, or no more than about 1/8 inches, no more than about 3/16 inches, or nor more than about 1/4 inches. Thicknesses outside of the foregoing ranges are also contemplated.

A thickness of the magnet 162 can affect the overall thickness of the rear connector 132. For example, in various embodiments, a thickness of the magnet 162 can be within a range of from about 1/4 to about 3/4 or from about 1/3 to about 2/3 of a total thickness of the rear connector 132, or can be no less than about 1/4, no less than about 1/3, no less than about 1/2, no less than about 2/3, or no less than about 3/4, of a total thickness of the rear connector 132.

A volume of the magnet 162 can affect its strength. In view of constraints that may be placed on the thickness of the magnet 162, an area defined by the surface 164 can be a variable that is altered or selected at the manufacturing stage. In various embodiments, the surface area of the surface 164 is within a range of from about 0.25 square inches to about 1.5 square inches, from about 0.5 square inches to about 1.25 square inches, or from about 0.75 square inches to about 1.0 square inches, or is no less than about 0.25 square inches, no less than about 0.5 square inches, no less than about 0.75 square inches, or no less than about 1.0 square inches.

Arrangements of the rear connector 132 other than that shown in FIGS. 2-4 are also contemplated. For example, in some embodiments, the magnet 162 can be secured within the casing 150 without the use of adhesives. For example, the casing 150 can be overmolded on the magnet 162, and a portion thereof may cover the front face 164 of the magnet 162. It is appreciated that such a casing 150 may reduce the strength of the magnetic field at a front surface of the connector 132 and/or may increase the thickness of the connector 132. In other embodiments, the casing 150 can be omitted and the adhesion member 159 can be joined directly to a rear face of the magnet 162.

With reference to FIG. 2, the front connector 134 can include a mount 170, such as the mount 140, which is secured to a magnetic target 190. The mount 170 can be configured to secure the magnetic target 190 to the wall hanging 102. The mount 170 can include a casing 180 that can be permanently attached to an adhesion member 189.

In some embodiments, the casing 180 can be identical to the casing 150 described above. For example, the casing 180 can be configured for use with mounting hardware such as the mounting hardware 160. In other embodiments, such as that illustrated in FIG. 2, the casing 180 can closely resemble the casing 150, but can be different in some respects. For example, in the illustrated embodiment, the casing 180 includes a rear face 182 such as the front face 152 of the casing 150, a front face 183 such as the rear face 153 of the casing 150, a recess 184 such as the recess 154 of the casing 150, a ridge 185 such as the ridge 155 of the casing 150, and can define a periphery or contour 187. However, the casing 180 does not include analogs to the tab 156 and the channel 158 of the casing 150. Accordingly, the contour 187 is different from the contour 157, in that it defines a substantially square outline with rounded corners, but without a rounded triangular portion projecting from one of the sides of the square.

In some embodiments, the magnetic target 190 can be similar to the magnet 162. For example, in some embodiments, the magnetic target 190 comprises a magnet 192 that is identical to the magnet 162, save for the orientation of its polarity. To illustrate, in the depicted embodiment, the magnetic target 190 comprises a magnet 192 having a rear face 194. A north pole of the magnet 192 can be at the rear face 194 and a south pole of the magnet 162 can be at the front face 164 of the magnet 162, or the south pole of the magnet 192 can be at the rear face 194 and the north pole of the magnet 162 can be at the front face 164 of the magnet 162. The magnets 162, 192 otherwise can be sized substantially the same and define magnetic fields that have substantially the same strength. As further discussed below, other configurations of the magnets 162, 192 are also possible.

In other embodiments, the magnetic target 190 comprises a material that is not magnetized (or not appreciably magnetized), but is attracted to a magnet; for example, the material can comprise a non-magnetized ferromagnetic material (e.g., iron, nickel, cobalt, various ferrites, etc.). Such materials may be referred to herein as "non-magnetized magnetic materials," whereas the term "magnetic materials" is sufficiently broad to encompass both magnetized materials and non-magnetized materials that are attracted to a magnet by an appreciable amount. In various embodiments in which the magnetic target 190 comprises a non-magnetized magnetic material, the magnetic target 190 can be substantially the same size and shape as the magnet 162. In other embodiments, the magnetic target 190 can have a different configuration from that of the magnet 162. For example, the target 190 can be smaller (e.g., thinner) than the magnet 162.

The adhesion member 189 can resemble the adhesion member 159 described above. In some embodiments, the adhesion members 159, 189 for a pair of connectors 132, 134 can be substantially identical to each other. In other embodiments, the adhesion member 189 can be configured to form a stronger or weaker bond than the adhesion member 159. For example, in some embodiments, the adhesion member 189 of the front connector 134 can comprise a pressure-sensitive adhesive that is configured to form a relatively strong or permanent bond with the wall hanging 104, whereas the adhesion member 159 of the rear connector 132 can comprise a selectively removable pressure-sensitive adhesive. In some embodiments, such as that illustrated in FIG. 2, the front connector 134 is attached to the wall hanging 102 solely via the adhesion member 187 (e.g., no mounting hardware is used).

In some embodiments, it can be desirable for the front connector 134 to define a relatively low profile. In various embodiments, a total thickness of the front connector 134 can be within a range of from about 1/16 inches to about 1/4 inches or from about 1/8 inches to about 3/16 inches, or no more than about 1/8 inches, no more than about 3/16 inches, or nor more than about 1/4 inches. Thicknesses outside of the foregoing ranges are also contemplated.

A thickness of the magnetic target 190 can affect the overall thickness of the front connector 134. For example, in various embodiments, a thickness of the magnetic target 190 can be within a range of from about 1/4 to about 3/4 or from about 1/3 to about 2/3 of a total thickness of the front connector 134, or can be no less than about 1/4, no less than about 1/3, no less than about 1/2, no less than about 2/3, or no less than about 3/4, of a total thickness of the front connector 134.

In various embodiments, a surface area defined by the surface 184 is within a range of from about 0.25 square inches to about 1.5 square inches, from about 0.5 square inches to about 1.25 square inches, or from about 0.75 square inches to about 1.0 square inches, or is no less than about 0.25 square inches, no less than about 0.5 square inches, no less than about 0.75 square inches, or no less than about 1.0 square inches.

With reference again to FIG. 1, a total thickness of the securing devices 120 (e.g., a total combined thickness of the front and rear connectors 134, 132 when they are in a coupled orientation) affects the spacing between the wall hanging 102 and the wall 104 at the location of the securing devices 120. In various embodiments, a total thickness of the securing devices 120 is within a range of from about 1/8 inches to about 1/2 inches or from about 1/4 inches to about 3/8 inches, or no more than about 1/4 inches, no more than about 3/8 inches, or nor more than about 1/2 inches. Thicknesses outside of the foregoing ranges are also contemplated.

In certain embodiments, the securing devices 120 can replace standard frame bumpers, which are usually placed at a bottom edge of a wall hanging 102 to prevent the wall hanging 102 from scraping or otherwise marring a wall 104. In some embodiments, the securing devices 120 are about as thick as the frame bumpers and can be placed at or near a bottom edge of the wall hanging 102 such that no appreciable visible distinction can be determined between a wall hanging that has frame bumpers and one that is fitted with securing devices 120.

As shown in FIG. 2, the particular configuration of the casings 150, 180, which are described above, are such that the front face 164 of the magnet 162 contacts the rear face 194 of the magnet 192 when the rear and front connectors 132, 134 are coupled with each other. In the illustrated embodiment, the interface of the front and rear faces 164, 194 of the magnets 162, 192 defines a plane that is substantially parallel to a plane defined by the wall 104. Moreover, the faces 182, 183, 152, 153 of the front and rear connectors 132, 134 are all parallel to one another, such that a rear face of the wall hanging 102 is also parallel to the wall 104. In other embodiments, the interface between the faces 164, 194 of the joined magnets 162, 192 and/or one or more of the faces 152, 153, 182, 183 can be angled relative to the wall 104, which, in some further embodiments, can result in a rear face of the wall hanging 102 likewise being angled relative to the wall 104.

With continued reference to FIG. 2, in some embodiments the front connector can include a magnet (e.g., the magnets 162), and the rear connector can include a magnetic target (e.g., the magnetic target 192). In other or further embodiments, the rear and front connectors 132, 134 can be interchangeable with each other. For example, the casings 150, 180 of the rear and front connectors 132, 134, respectively, each can include a tab 156 and a channel 158 for mounting hardware.

Figure 5A:
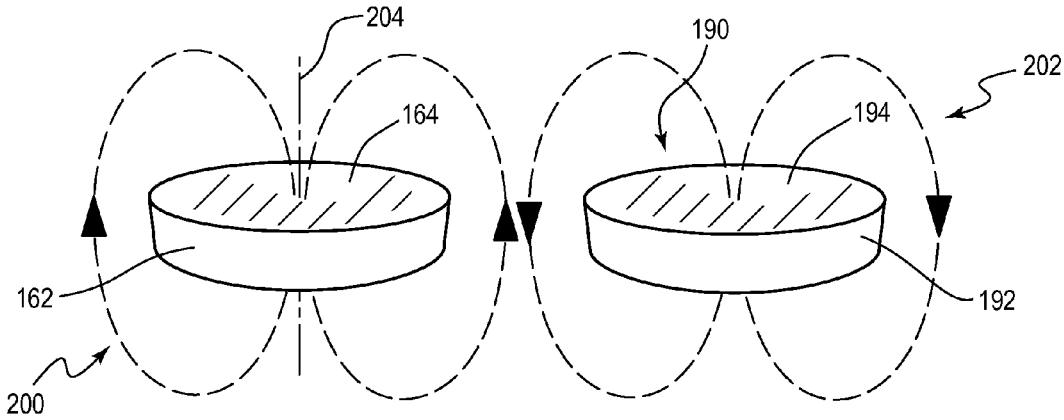
FIG. 5A is a perspective view of an embodiment of a magnet and an embodiment of a magnetic target that are compatible with the securing system of FIG. 1 and are shown in a decoupled state.

FIG. 5A illustrates the magnet 162 and the magnetic target 190, which in the illustrated embodiment comprises the magnet 192, in a decoupled state. The casings 150, 190 and other portions of the rear and front connectors 132, 134 are not shown for purposes of clarity. The front face 164 of the magnet 162 defines a surface area that is the same size as a surface area defined by the rear face 194 of the magnet 192. Moreover, each of the front and rear faces 164, 194 is circular such that each is rotationally symmetrical.

The magnet 162 defines a magnetic field 200, and the magnet 192 defines an oppositely directed magnetic field 202. In the illustrated embodiment, the strengths of the magnetic fields 200, 202 are identical. When the magnets 162, 192 are brought into proximity with each other, the magnetic fields 200, 202 interact with each other so as to urge the front face 164 toward the rear face 194. In an arrangement such as that shown in FIG. 2, the magnetic fields 200, 202 interact so as to bring the faces 164, 194 into contact with each other.

Moreover, the interaction of the magnetic fields 200, 202 can urge the faces 164, 194 toward each other in a predetermined orientation. For example, in the embodiment illustrated in FIG. 5A, the magnetic fields 200, 202 interact so as to align the circumferences of the faces 164, 194. Stated otherwise, the magnetic fields 200, 202 interact so as to maximize the amount of the surface area of the face 164 that faces the surface area of the face 194.

The magnet 162 can define an axis 204 that extends through the center of its front face 164. When the magnets 162, 192 are coupled with each other, the faces 164, 194 can be aligned with each other such that the axis 204 extends through a center of the face 194. Due to the rotational symmetry of the magnets 162, 192, the predetermined orientation in which the magnets 162, 192 couple with each other can comprise any rotational position of the magnet 192 about the axis 204. Accordingly, numerous positions are possible.

In other embodiments, the magnetic target 190 can comprise a non-magnetized magnetic material, such that substantially no magnetic field 202 is produced thereby. In certain of such embodiments, it can be desirable to increase the strength of the magnetic field 200 so as to compensate for the absence of the magnetic field 202.

Figure 5B:
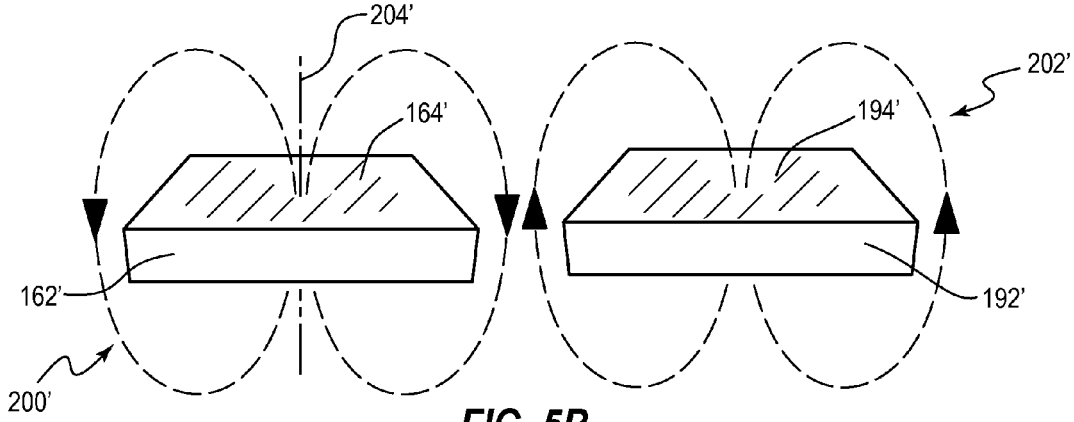
FIG. 5B is a perspective view of another embodiment of a magnet and another embodiment of a magnetic target that are compatible with the securing system of FIG. 1 and are shown in a decoupled state.

FIG. 5B illustrates another embodiment of magnets 162', 192', which include faces 164', 194' and define magnetic fields 200', 202'. The faces 164', 194' are substantially identical elongated rectangles. When the faces 164', 194' are urged toward each other via the magnetic fields 200', 202', the faces 164', 194' preferentially align with each other. For example, if the faces 164', 194' are allowed to touch, the perimeters thereof are preferentially coextensive with each other. However, the rotational symmetry of the magnets 162', 192' about an axis 204' is not as extensive as the rotational symmetry of the magnets 162, 192 about the axis 204 shown in FIG. 5A. In particular, two distinct preferred alignments exist, which are rotationally spaced from each other by 180 degrees. Other arrangements can include more than two preferred alignments. For example, equilateral triangular shapes can define three preferred alignments.

Figure 5C:
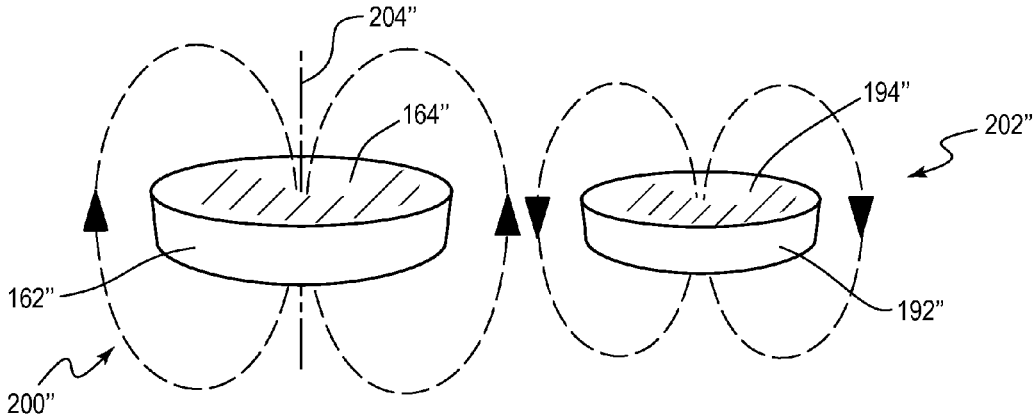
FIG. 5C is a perspective view of another embodiment of a magnet and another embodiment of a magnetic target that are compatible with the securing system of FIG. 1 and are shown in a decoupled state

FIG. 5C illustrates another embodiment of magnets 162", 192", which include faces 164", 194" and define magnetic fields 200", 202". The magnet 162" is larger than the magnet 194", and the magnetic field 200" is stronger than the magnetic field 202". Due to the rotational symmetries of the magnetic fields 200", 202", the predetermined orientation in which the magnet 162" couples with the magnet 192" can include any rotational position of the magnet 192" about an axis 204" in which the axis 204" extends through a center of each of the faces 164", 194".

The predictability and repeatability of the predetermined orientations in which a magnet 162 couples with a target 190 can aid in ensuring that a wall hanging 102 is maintained in a desired orientation. Moreover, this property can permit quick and easy removal and re-hanging of the wall hanging 102 in the same desired orientation.

Figure 7:
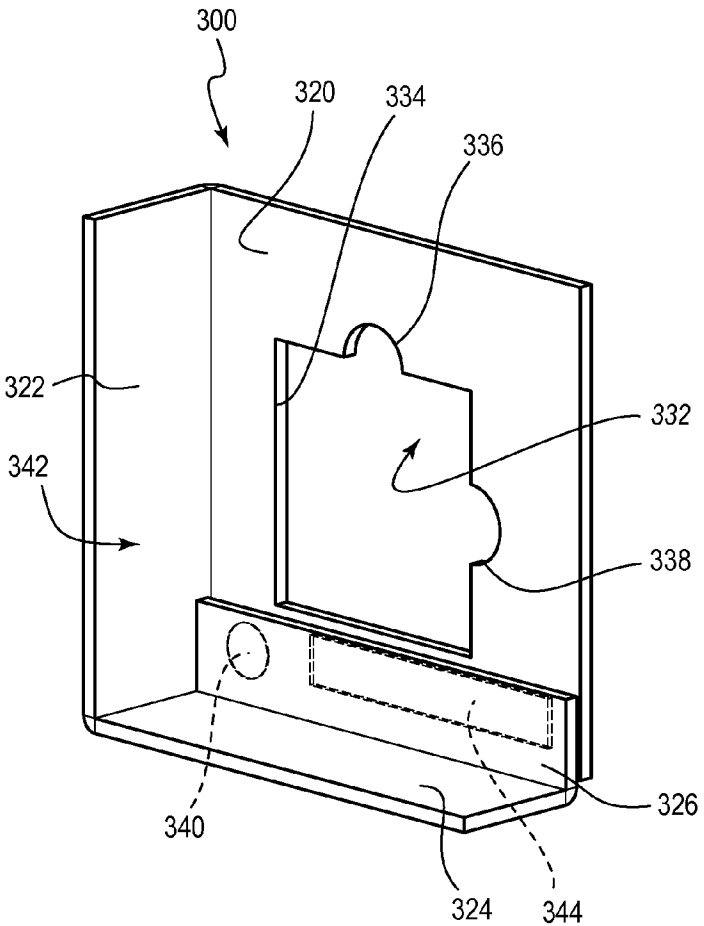
FIG. 7 is a front perspective view of the positioning template of FIG. 6 in an assembled state.
Figure 6:
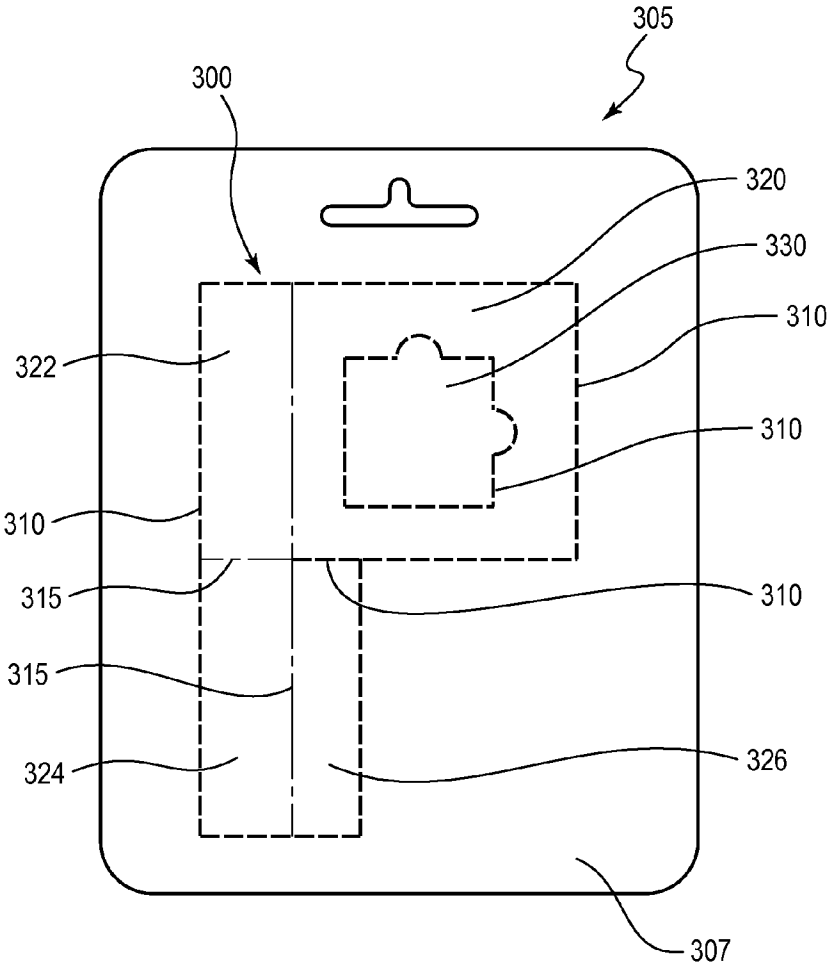
FIG. 6 is a rear plan view of an embodiment of a packaging unit that is configured to store at least a portion of a securing system and that includes an embodiment of a positioning template integrally formed therewith.

With reference to FIGS. 6 and 7, in certain embodiments a positioning template 300 can be provided to aid in positioning the securing devices 120. With reference in particular to FIG. 6, in some embodiments, packaging 305 is used for the distribution and marketing of the securing devices 120. In various embodiments, the packaging 305 can contain one or more, two or more, three or more, or four or more securing devices 120. The packaging 305 can be of any suitable variety, such as blister packaging. In the illustrated embodiment, a blister package includes a base 307 to which a plastic cover (not shown) is secured. Only the rear face of the base 307 is shown. The positioning template 300 can be integrally formed with the base 307 and can be separated from the base 307, as further discussed below. In other embodiments, the positioning template 300 may be independent of the base 307, and may instead be included within the packaging 305.

In the illustrated embodiment, the base 307 includes a series of frangible lines 310 that are configured to permit one portion of the base 307 to be punched out or otherwise removed from another portion thereof. The base 307 further includes a series of fold lines 315. The fold lines 315 can include printed markings and/or scoring. Portions of the base 307 that are outlined by one or more lines 310, 315 can be identified as a rear wall 320, a first sidewall 322, a second sidewall 324, an attachment flange 326, and an aperture piece 330.

FIG. 7 shows the positioning template 300 in an assembled state. The aperture piece 330 has been removed such that the rear wall 320 defines an aperture 332. In particular, a contoured edge 334 of the rear wall 320 defines the aperture 332. The contoured edge 334 can be complementary to at least a portion of one or more of the rear and front connectors 132, 134. For example, the contoured edge 334 can include a notch 336 that is configured to receive the tab 156 of the casing 150 when the template 300 is in a first orientation, and can include a notch 338 that is configured to receive the tab 156 of the casing 150 when the template 300 is in a second orientation.

The attachment flange 326 is adhered to the rear wall 320 via an adhesive patch 340, which can be included in the packaging 305. The rear wall 320 and the first and second sidewalls 322, 324 cooperate to define a receptacle 342. A depth of the receptacle 342 can be determined by the width (e.g., the depth) of the sidewalls 322, 324. As will be apparent from the discussion below, in some embodiments, the width of the sidewalls 322 can desirably be larger than a total thickness of a securing device 120. An adhesion member 344 can be secured to a rear face of the rear wall 320. The adhesion member 344 can comprise a relatively weak selectively removable pressure-sensitive adhesive.

Illustrative methods for installing a securing device 120 using the template 300 will now be described. The wall hanging 102 is hung on the wall 104 via the wall-hanging system 110 (see FIG. 1) in a desired orientation. In some cases, the desired orientation may be substantially level. Accordingly, in some embodiments, a level may be used to place the wall hanging 102 in the desired orientation. In some embodiments, a level may be included in the packaging 305 for this purpose.

The template 300 is oriented in the position shown in FIG. 7 such that the first sidewall 322 is substantially vertical and the second sidewall 324 is substantially horizontal. The rear wall 320 of the template 300 is slid behind the bottom left corner of the wall hanging 102. The bottom left corner of the wall hanging 102 is pressed toward the wall 104 to activate the adhesion member 344 so as to temporarily secure the template 300 to the wall 104. The wall hanging 102 is either removed from the wall 104 (e.g., lifted from the picture hook 112), or remains attached to the wall-hanging system 110 but is rotated out of the way so as not to obscure the template 300.

The rear connector 132 (see FIGS. 2-4) is prepared for being fixedly secured to the wall 104, which can include removal of a removable cover from the adhesion member 159. The rear connector 132 is then inserted through the aperture 332 of the template 300 into contact with the wall 104. The mounting hardware 160 can be secured to the wall 104 and/or the adhesion member 159 can be activated (e.g., pressure can be applied to a selectively removable pressure-sensitive adhesive).

In some embodiments, the front connector 134 is coupled with the rear connector 132 prior to securing the rear connector 132 to the wall 104. In other embodiments, the front connector 134 is coupled to the rear connector 132 after the rear connector 132 has been secured to the wall 104. In either case, the front connector 134 can be prepared for attachment to the wall hanging 102 either before or after it is coupled with the front connector 132. Preparing the front connector 134 for attachment can include removing a removable cover from the adhesion member 189.

The wall hanging 102 is returned to the wall-hanging system 110 (e.g., re-hung on the picture hook 112), or is rotated back in place, such that the bottom left corner of the wall hanging 102 again contacts the first and second sidewalls 322, 324 of the template 300. The bottom left corner of the wall hanging 102 is pressed toward the wall 104 to activate the adhesion member 189 such that the front connector 134 is fixedly secured to the wall hanging 102.

The method can be repeated at the lower right corner of the wall hanging 102 with another securing device 120. However, the template is rotated 90 degrees such that, when used, the first wall 322 is substantially horizontal and the second wall 324 is substantially vertical. Other suitable methods and systems for installing the securing devices 120 are also possible, including those in which the template 300 is not employed.

In some embodiments, the coupling force between the rear and front connectors 132, 134 is sufficiently strong to maintain the wall hanging 102 in the desired position, but is weaker than a bond strength between the rear connector 132 and the wall 104 and/or between the front connector 134 and the wall hanging 102. The wall hanging 102 thus can be selectively removed from the wall 104 by a user upon application of sufficient force without disassembling the securing system 100. Rather, the securing system 100 is merely transitioned to a decoupled state. Such a securing system 100 can allow for repeated removal of the wall hanging 102 and for quick and easy return of the wall hanging 102 to its desired orientation. For example, if the wall hanging 102 includes a framed item that is subject to frequent changes, such as an employee-of-the-month display, the display can be removed, replaced, and re-hung with relative ease.

In some embodiments, the securing system 100 can be used in conjunction with a wall-hanging system 110 such as described above. In other embodiments, the securing system 100 can be used independent of such a wall-hanging system 110.

The foregoing disclosure recites various embodiments that include systems for securing a wall hanging in a desired orientation. Examples of means for emanating a magnetic field include the magnets 162, 162', 162". Examples of means for attaching the means for emanating with one of a wall hanging and a wall includes the adhesion member 159 and the mounting hardware 160. Examples of means for interacting with the magnetic field emanated by the means for emanating include the magnetic target 190 and the magnets 192, 192', 192". An example of means for attaching the means for interacting is the adhesion member 189 and the mounting hardware 160.

Methods related to the disclosed securing systems 100, their respective components and features, and their use are supported by this disclosure and will be evident to the skilled practitioner. For example, actions described in this disclosure can form the basis of method steps. Moreover, any suitable combination of actions disclosed with respect to the securing systems 100, and their respective components and features, is contemplated by this disclosure.

It will be understood by those having skill in the art that many changes may be made to the details of the above-described embodiments without departing from the underlying principles of the present invention. The scope of the present invention should, therefore, be determined only by the following claims. Recitation in the claims of the term "first" with respect to a feature or element does not necessarily imply the existence of a second or additional such feature or element. Elements recited in means-plus-function format are intended to be construed in accordance with 35 U.S.C. §112¶6.

The invention claimed is:

1. A wall hanging system for securing a wall hanging in a desired orientation, the system comprising:

a first magnet having a first surface and defining a first magnetic field;

a first mount attached to the first magnet, wherein the first mount is configured to be secured to one of a wall hanging and a wall in a fixed position and wherein the first mount comprises a casing that defines a ridge extending around at least a portion of the first magnet, the ridge defining an opening through which hardware can pass to secure the first mount to one of the wall and the wall hanging;

a first magnetic target having a second surface, wherein the first magnetic field is configured to interact with the first magnetic target so as to urge the second surface of the first magnetic target toward the first surface of the first magnet when the first magnet and the first magnetic target are brought into proximity with each other;

a second mount attached to the magnetic target, wherein the second mount is configured to be secured to the other of the wall hanging and the wall in a fixed position;

a second magnet having a third surface and defining an additional magnetic field;

a third mount attached to the second magnet, wherein the third mount is configured to be spaced from the first mount and secured to one of the wall hanging and the wall;

a second magnetic target having a fourth surface, wherein the additional magnetic field is configured to interact with the second magnetic target so as to urge the fourth surface of the second magnetic target toward the third surface of the second magnet when the second magnet and the second magnetic target are brought into proximity with each other; and a fourth mount attached to the second magnetic target, wherein the fourth mount is configured to be secured to the other of the wall hanging and the wall.

2. The system of claim 1, wherein the first magnetic target comprises a third magnet.

3. The system of claim 1, wherein the first surface of the first magnet defines a first surface area and the second surface of the first magnetic target defines a second surface area, wherein the first and second surface areas are approximately the same.

4. The system of claim 1, wherein a combined thickness of the first magnet and the first mount is no greater than about ⅛ inch.

5. The system of claim 4, wherein the combined thickness of the first magnetic target and the second mount is no greater than about ⅛ inch.

6. The system of claim 1, wherein the casing comprises a surface opposite the first surface of the first magnet, and wherein a pressure-sensitive adhesive is secured to said surface of the casing.

7. The system of claim 6, wherein the pressure-sensitive adhesive comprises a selectively removable pressure-sensitive adhesive such that the first mount can be selectively attached to and selectively removed from a wall surface without damaging the wall surface.

8. A wall hanging system for securing a wall hanging in a desired orientation, the system comprising:

a first magnet having a first surface and defining a first magnetic field;

a first mount attached to the first magnet, wherein the first mount is configured to be secured to one of a wall hanging and a wall in a fixed position;

a magnetic target having a second surface, wherein the first magnetic field is configured to interact with the magnetic target so as to urge the second surface of the magnetic target toward the first surface of the first magnet when the first magnet and the magnetic target are brought into proximity with each other;

a second mount attached to the magnetic target, wherein the second mount is configured to be secured to the other of a wall hanging and a wall in a fixed position;

a positioning template that defines a contoured edge, wherein the contoured edge is complementary to at least a portion of a periphery of at least one of the first and second mounts, wherein the positioning template comprises a selectively removable pressure-sensitive adhesive; and packaging in which the first magnet and the magnetic target are contained, wherein the positioning template is integrally formed with the packaging and is separable from the packaging.

* * * * *